US009145011B2

(12) United States Patent
Sosnowski et al.

(10) Patent No.: US 9,145,011 B2
(45) Date of Patent: Sep. 29, 2015

(54) PRINTING SYSTEM WITH FORCE CONTROL MODE

(71) Applicant: Hewlett-Packard Development Company, L.P., Houston, TX (US)

(72) Inventors: Luke P. Sosnowski, Vancouver, WA (US); Pierre J. Kaiser, Vancouver, WA (US); Alexander Toia, Vancouver, WA (US); Arthur H. Barnes, Vancouver, WA (US); Erich Waldherr Hacker, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 338 days.

(21) Appl. No.: 13/756,404

(22) Filed: Jan. 31, 2013

(65) Prior Publication Data

US 2014/0210895 A1 Jul. 31, 2014

(51) Int. Cl.
*B41J 13/00* (2006.01)

(52) U.S. Cl.
CPC ..... *B41J 13/0027* (2013.01)

(58) Field of Classification Search
CPC .... B41J 29/38; B41J 11/42; B65H 5/00–5/38
USPC ..... 347/16; 271/264–277, 10.11
See application file for complete search history.

(56) References Cited

U.S. PATENT DOCUMENTS

| | | | | |
|---|---|---|---|---|
| 4,018,431 | A | 4/1977 | Schueler | |
| 5,624,196 | A | 4/1997 | Jackson et al. | |
| 6,325,559 | B1 | 12/2001 | Kaiser et al. | |
| 6,435,641 | B1 | 8/2002 | Tung et al. | |
| 2005/0270354 | A1 * | 12/2005 | Taguchi et al. | 347/104 |
| 2006/0087548 | A1 | 4/2006 | Noh | |
| 2007/0001369 | A1 * | 1/2007 | Murrell et al. | 271/10.11 |
| 2008/0186349 | A1 * | 8/2008 | Jang | 347/16 |
| 2010/0219581 | A1 | 9/2010 | Yamada | |
| 2012/0105531 | A1 | 5/2012 | Gilbert et al. | |

OTHER PUBLICATIONS

"Trying to Print Business Cards", Aug. 31, 2009, 4 pgs., Retrieved from <<http://h30434.www3.hp.com/t5/Other-Printing-Questions/Trying-to-print-business-cards/td-p/113708>>.

* cited by examiner

*Primary Examiner* — Justin Seo
(74) *Attorney, Agent, or Firm* — Dicke, Billig & Czaja, PLLC

(57) ABSTRACT

A printing system includes a printhead to eject ink onto a print medium in a print zone. A first roller pair is adjacent to the print zone to advance a print medium into the print zone. A second roller pair upstream from the first roller pair, and driven by an independent motor, advances the print medium to the first roller pair in a position control mode. A controller causes the second roller pair to switch from the position control mode to a force control mode when a leading edge of the print medium reaches the first roller pair. The second roller pair applies a substantially constant force to the print medium in the force control mode to push the leading edge of the print medium against the first roller pair while the first roller pair is stationary.

13 Claims, 6 Drawing Sheets

PRINTING SYSTEM WITH FORCE CONTROL MODE

BACKGROUND

Printing an image on media involves registration of the sheet such that the image has a uniform gap with the top edge of the media, also known as the top margin. If the top margin is not under control, then the user's image will be printed starting at various distances from the top of the page, resulting in user dissatisfaction.

DETAILED DESCRIPTION

Figure 1:
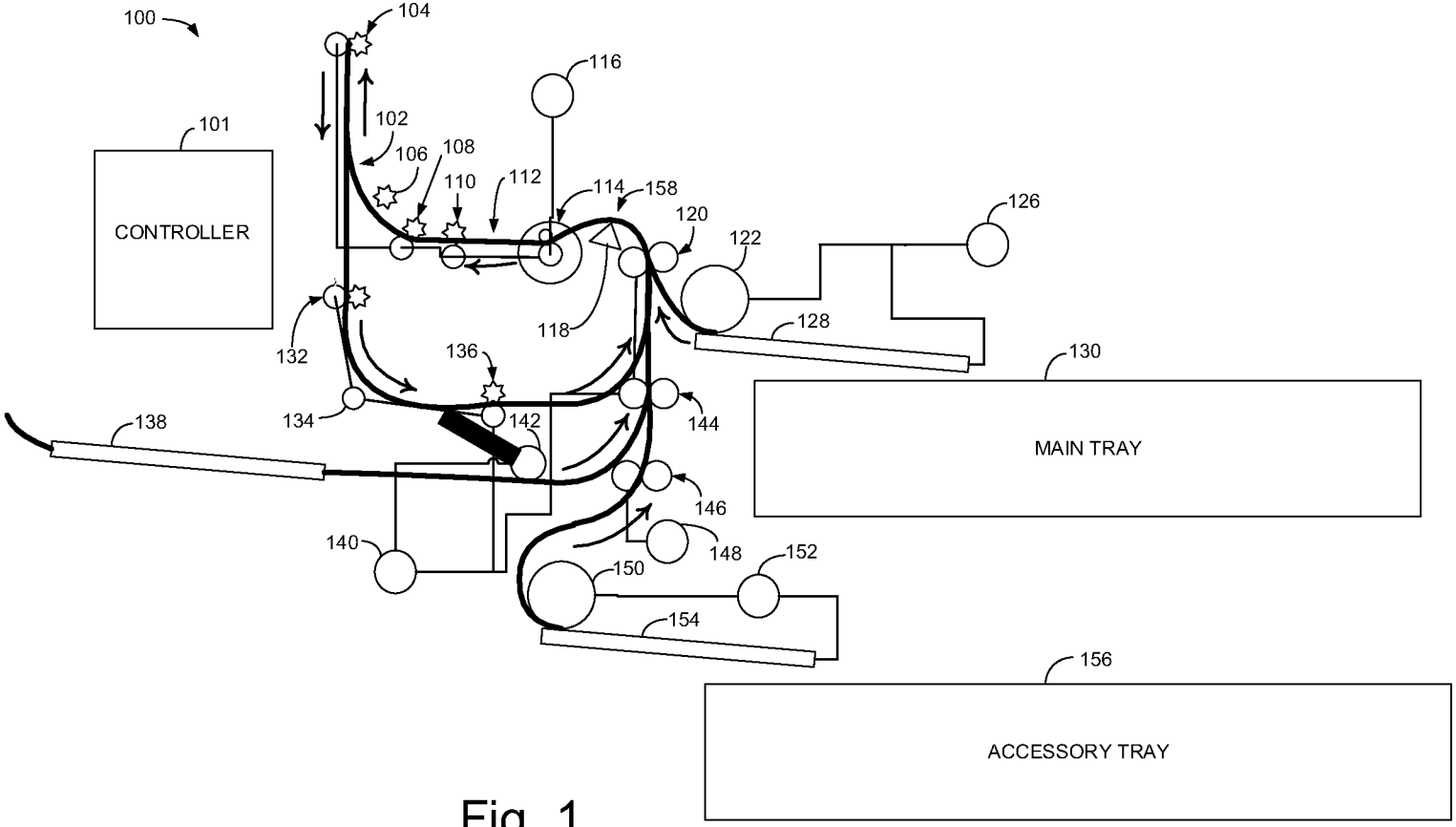
FIG. 1 is a block diagram of a printer system according to one implementation.

In the following detailed description, reference is made to the accompanying drawings which form a part hereof, and in which is shown by way of illustration specific embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims. It is to be understood that features of the various embodiments described herein may be combined with each other, unless specifically noted otherwise.

One method for providing a consistent top margin involves using an opto-mechanical registration flag upstream of the feed pinch. The flag is used to detect the leading edge of the media prior to the entry into the feed nip and prior to any deskew operation. A skew-control algorithm moves the paper into contact with the feed nip based on a fixed offset from the registration flag. Once the media is in this position, the method relies on force stored in a media buckle to engage the leading edge of the media into the feed pinch. This method has reasonable reliability on plain paper, but is not as effective on specialty media such as brochure, envelopes, or cardstock. The energy stored in the media buckle is insufficient to reliably push specialty media into the nip as the feed roller begins rotation.

Another method for providing a consistent top margin in a scanning inkjet printer involves using a sensor mounted to the scanning carriage adjacent to the marking system and in the axis of travel of the marking system. The sensor performs optical detection of the leading edge of the media in the print zone. The carriage is positioned in the print zone and the sensor detects the leading edge of the media after it has been fed through the feed nip but before printing begins. The sensor on the carriage addresses this issue of providing a consistent top margin by using closed loop feedback from the sensor. This sensor may be used in tandem with the mechanical registration flag upstream of the feed pinch (discussed above). However, some page-wide array (PWA) products with a PWA printhead do not have room for a sensor on the printbar, and print zone contact sensors located on the platen are expensive, prone to contamination, and may cause paper feed reliability issues. In addition, this method cannot be easily used for PWA applications due to the fixed printhead completely obscuring the region of the print zone usually used for sensing. Another drawback to a printzone top of form sensor is that it may limit the top speed of media going through the printzone, since at high speeds there may not be sufficient time to trigger printing.

Another method for providing a consistent top margin involves using an opto-mechanical registration flag in the print zone. This method places a mechanical flag in the print zone to sense the leading edge after transition through the nip, and may be used in tandem with the mechanical registration flag upstream of the feed pinch (discussed above). However, the flag is prone to contamination by ink spray and paper debris and may cause media control issues in the print zone, with media being levered off the print zone ribs and the tail end of the media being lifted. The additional sensor is also costly.

One implementation provides improved top of form registration for specialty media by means of a force-limited load algorithm. A specialty medium or specialty print medium as used herein includes all forms of print media other than plain paper, such as special paper, transparencies, card-stock, envelopes, and others. One implementation is directed to a method for removing top margin variation from media by continuously forcing the sheet into a stationary roller-pinch system. The continuous push force enables the leading edge of the media to force its way into the feed roller pinch immediately upon its forward rotation and enables the feed roller pinch to reliably and immediately pick up the top edge of the media upon forward rotation, resulting in successful registration. This method is especially useful for stiff and slippery media that tend to stall immediately before entering the feed nip. On brochure media, envelopes, and card stock, this algorithm reduced top-margin registration failure rates that approached 100% on some units down to 0%. Specific implementations disclosed herein use existing hardware and carry no additional hardware cost or reliability issues. This method can be used on plain paper media with reduced level of performance.

FIG. 1 is a block diagram of a printer system 100 according to one implementation. System 100 includes controller 101, print medium path 102, output star wheel pinches 104, 108, and 110, star wheel 106, print zone 112, feed roller pinch (or feed roller pair) 114, feed motor 116, optical media edge sensor 118, turn roller pinch (or turn roller pair) 120, main pick roller 122, main tray pick motor 126, main tray lift 128, main tray 130, duplex star wheel pinches 132 and 136, power take off (PTO) connection 134, multi-purpose (MP) tray 138, duplex and MP tray motor 140, MP pick roller 142, MP roller pinch 144, accessory roller pinch 146, accessory turn motor 148, accessory pick roller 150, accessory pick motor 152, accessory tray lift 154, accessory tray 156, and paper buckle 158.

In operation, the system 100 receives a print medium upon which text, graphics or other symbols are to be recorded. In one implementation, system 100 is implemented as a page-wide array (PWA) inkjet printer that receives a print job from a host computer (not shown). The print medium is driven along the print medium path 102 until it reaches the print zone 112, where a PWA printhead ejects ink and records the text, graphics, or other symbols indicated by the print job onto the print medium. In various implementations, the system 100 may be implemented as a computer printer, graphics plotter, copier machine, and/or facsimile machine. Controller 101 performs the various control functions described herein.

The direction of movement of a print medium through system 100 is represented by arrows in FIG. 1. In the illustrated implementation, a print medium can be fed into system 100 at three different locations—MP tray 138, main tray 130, and accessory tray 156. Regardless of which of these three locations the print medium originates from, the print medium eventually ends up at the turn roller pinch 120. A print medium that starts in the MP tray 138 travels through MP pick roller 142 and MP roller pinch 144 to reach the turn roller pinch 120. A print medium that starts in the main tray 130 travels through main pick roller 122 to reach the turn roller pinch 120. A print medium that starts in the accessory tray 156 travels through accessory pick roller 150, accessory roller pinch 146, and MP roller pinch 144 to reach the turn roller pinch 120.

After reaching the turn roller pinch 120, a print medium travels through the turn roller pinch 120, passes by sensor 118, forms a buckle 158, and then travels through feed roller pinch 114, print zone 112, output star wheel pinch 110, output star wheel pinch 108, star wheel 106, and output star wheel pinch 104. In a duplex printing mode, a print medium is reversed from output star wheel pinch 104, travels through duplex star wheel pinches 132 and 136, and is then returned to turn roller pinch 120.

Feed motor 116 drives feed roller pinch 114, and output star wheel pinches 104, 108, and 110. Main tray pick motor 126 drives main pick roller 122 and main tray lift 128. MP tray motor 140 drives MP pick roller 142, duplex star wheel pinches 132 and 136, MP roller pinch 144, and turn roller pinch 120. Accessory turn motor 148 drives accessory roller pinch 146. Accessory pick motor 152 drives accessory pick roller 150 and accessory tray lift 154.

In one implementation, system 100 uses a push mode or force control mode whenever the system 100 is printing on a specialty media (e.g., any media other than plain paper). When a user is about to send a print job to system 100, the user selects a type of print medium for the print job. The type of print medium can also be pre-set by the user for each tray, so that the print medium does not have to be explicitly set for each job. The printer driver then informs the system 100 of the selected type of print medium for the print job, and if the selected type is a specialty print medium, the system 100 automatically uses the force control mode for the print job.

After picking or duplexing a specialty print medium, system 100 eventually drives the specialty print medium into the turn roller pinch 120 to make a 90 degree turn towards the feed roller pinch 114, which feeds the print zone 112. The print medium is fed through the turn and triggers the optical sensor 118. The print medium continues to feed an additional fixed distance until it contacts the stationary feed roller pinch 114 and forms a buckle 158. At this time, the motion control of the rollers upstream of the feed roller pinch 114 is switched to the force control mode. In the force control mode according to one implementation, the rollers apply a fixed amount of forward force to the print medium. This force is independent of the force stored in the paper buckle, and it locks the print medium tightly into the feed nip after a short time period (e.g., a few milliseconds (ms)). As a result, immediately after the feed roller pinch 114 begins forward rotation, the top edge of the print medium transitions through the feed roller pinch 114, ensuring correct registration. The force control mode of the upstream rollers is deactivated after a predetermined amount of motion of the feed roller pinch 114, and a regular position controlled move is initiated for the upstream rollers to match the feed roller pinch 114.

In one implementation, controller 101 monitors the force control mode to ensure that the upstream rollers do not move an excessive distance. This monitoring helps prevent jams by paper crumpling in the buckle zone in cases where the user accidentally prints on lightweight media (e.g., plain paper) with specialty media settings.

Figure 2:
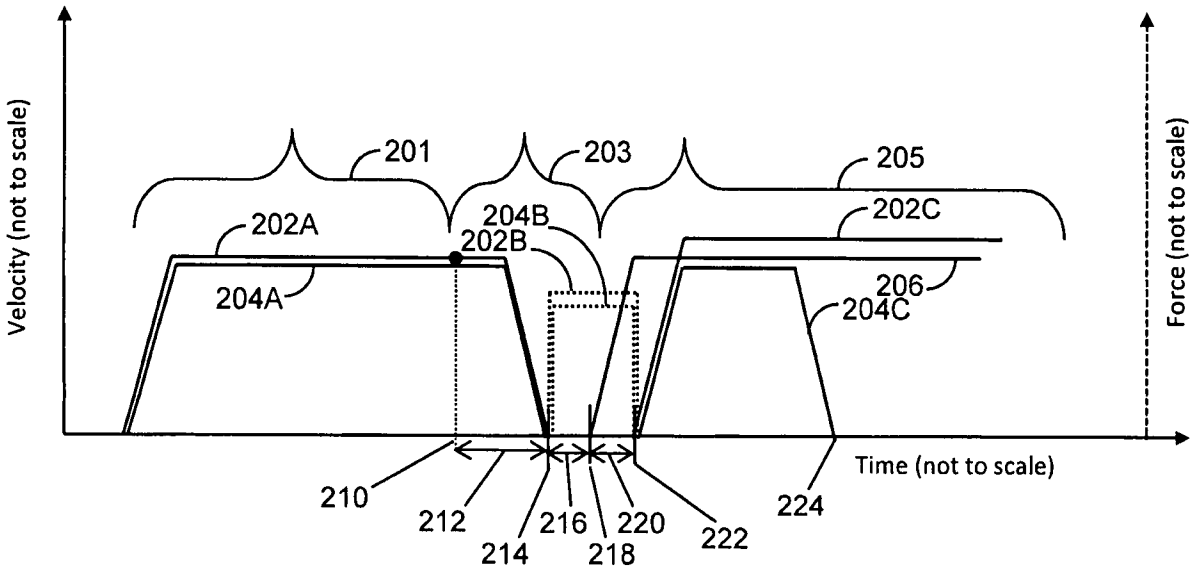
FIG. 2 is a diagram illustrating a graph of drive velocity versus time and force versus time for driving a specialty print medium from the main tray through the print zone according to one implementation.
Figure 3:
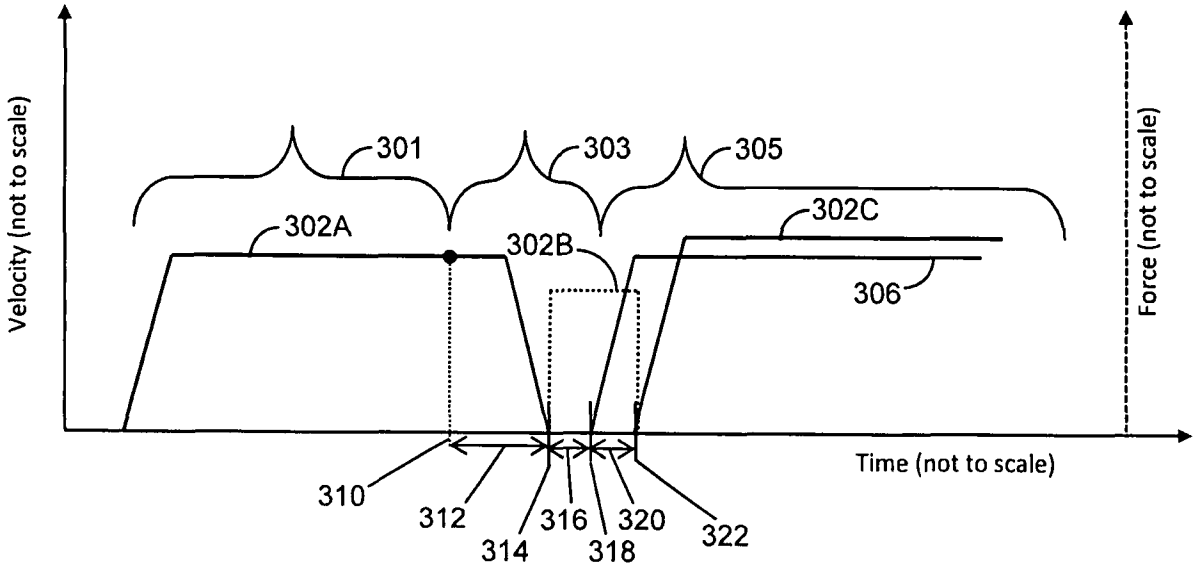
FIG. 3 is a diagram illustrating a graph of drive velocity versus time and force versus time for driving a specialty print medium from the multi-purpose (MP) tray through the print zone according to one implementation.
Figure 4:
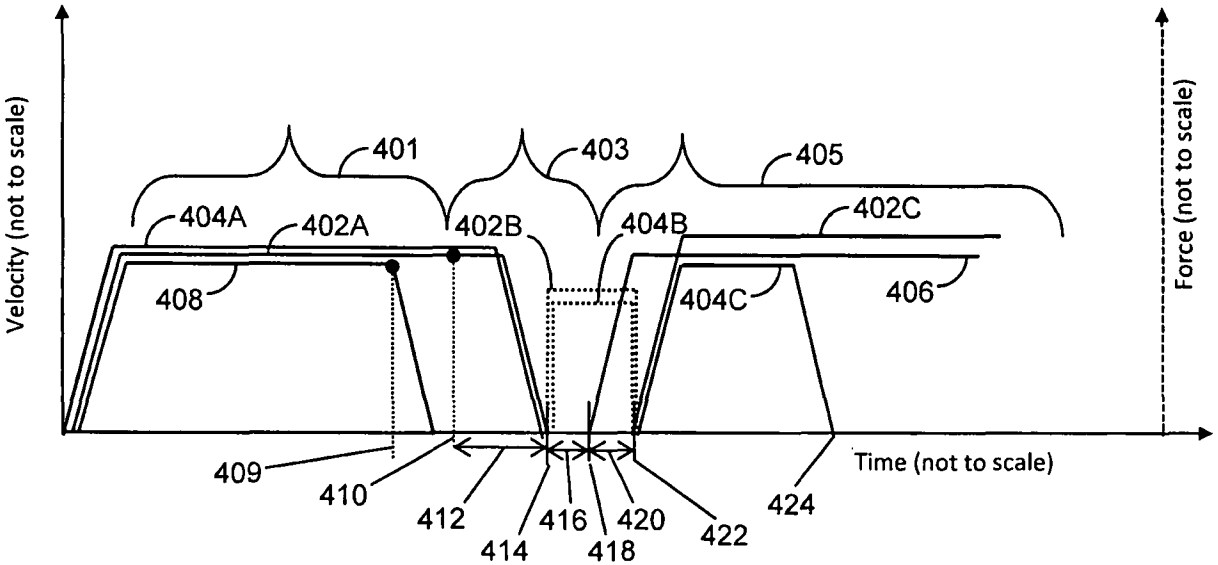
FIG. 4 is a diagram illustrating a graph of drive velocity versus time and force versus time for driving a specialty print medium from an accessory tray through the print zone according to one implementation.

FIGS. 2-4 are diagrams illustrating graphs of drive velocity versus time and force versus time for driving a specialty print medium through the print zone 112. These figures illustrate the push mode or a force control mode, which, in one implementation, is used whenever the system 100 is printing on a specialty media.

FIG. 2 is a diagram illustrating a graph of drive velocity versus time and force versus time for driving a specialty print medium from the main tray 130 through the print zone 112 according to one implementation. The graph includes a load phase 201, a registration phase 203, and a print phase 205. Curves 202A and 202C represent the velocity over time produced by the MP tray motor 140, which drives the turn roller pinch 120. Curve 202B represents the force over time produced by the MP tray motor 140. Curves 202A and 202C are shown with solid lines, which represent a position control mode, and curve 202B is shown with dashed lines, which represents a push mode or a force control mode. Curves 204A and 204C represent the velocity over time produced by the main tray pick motor 126, which drives the main pick roller 122. Curve 204B represents the force over time produced by the main tray pick motor 126. Curves 204A and 204C are shown with solid lines, which represent a position control mode, and curve 204B is shown with dashed lines, which represents a push mode or a force control mode. Curve 206 represents the velocity over time produced by the feed motor 116, which drives the feed roller pinch 114. Curve 206 is shown with a solid line, which represents a position control mode.

As shown in FIG. 2, the loading phase 201 begins with the velocities produced by the MP tray motor 140 (curve 202A) and the main tray pick motor 126 (curve 204A) beginning to ramp up. These curves 202A and 204A then hold steady at a constant velocity for a period of time, and then ramp back down to zero. Point 210 in the graph represents the point in time at which the print medium has reached the sensor 118, causing the sensor 118 to generate a signal. Point 210 also represents the point in time at which the load phase 201 ends and the registration phase 203 begins. After the signal is generated by the sensor 118, the print medium is moved a predetermined amount or a predetermined number of encoder counts (e.g., 2400 encoder counts, where 1 count equals 1/2400" of paper motion), which occurs at the end of time period 212.

At point 214, the leading edge of the print medium is presumed to be in contact with the feed roller pinch 114, which is stationary at this point in time, so the leading edge does not advance through the feed roller pinch 114. At point 214, the MP tray motor 140 and the main tray pick motor 126 switch to a force control mode and apply a constant force to the print medium, which is represented by curves 202B and 204B, respectively. The constant force results in a constant pushing of the print medium leading edge against the feed roller pinch 114. After a predetermined time (e.g., 50 ms) of applying the constant force with motors 126 and 140, which is represented by time period 216, the feed motor 116 is turned on at point 218, and the velocity produced by the feed motor 116 (curve 206) begins to ramp up. When the feed motor 116 is turned on at point 218, the feed roller pinch 114 begins rotating, causing the leading edge of the print medium to begin to go through the feed roller pinch 114. The print medium does not slip due to the upstream pinch forcing the print medium top edge into pinch 114. After point 218, the registration phase 203 ends and the printing phase 205 begins, and motors 126 and 140 continue to apply a constant force until the print medium has moved a predetermined amount or a predetermined number of encoder counts (e.g., 200 encoder counts), which occurs during time period 220.

At point 222, after the feed roller pinch 114 has moved the predetermined amount during time period 220, the motors 126 and 140 switch back to a position control mode, and the velocities produced by motors 126 and 140 begin to ramp up and then level off to a constant velocity, as shown by curves 204C and 202C, respectively, to drive the print medium along with motor 116 through the print zone 112 for printing. At point 224, the velocity produced by main tray pick motor 126 ramps down as the trailing edge of the print medium leaves the rollers controlled by this motor.

FIG. 3 is a diagram illustrating a graph of drive velocity versus time and force versus time for driving a specialty print medium from the MP tray 138 through the print zone 112 according to one implementation. The graph includes a load phase 301, a registration phase 303, and a print phase 305. Curves 302A and 302C represent the velocity over time produced by the MP tray motor 140, which drives the turn roller pinch 120. Curve 302B represents the force over time produced by the MP tray motor 140. Curves 302A and 302C are shown with solid lines, which represent a position control mode, and curve 302B is shown with dashed lines, which represents a push mode or a force control mode. Curve 306 represents the velocity over time produced by the feed motor 116, which drives the feed roller pinch 114. Curve 306 is shown with a solid line, which represents a position control mode.

As shown in FIG. 3, the loading phase 301 begins with the velocity produced by the MP tray motor 140 (curve 302A) beginning to ramp up. This curve 302A then holds steady at a constant velocity for a period of time, and then ramps back down to zero. Point 310 in the graph represents the point in time at which the print medium has reached the sensor 118, causing the sensor 118 to generate a signal. Point 310 also represents the point in time at which the load phase 301 ends and the registration phase 303 begins. After the signal is generated by the sensor 118, the print medium is moved a predetermined amount or a predetermined number of encoder counts (e.g., 2400 encoder counts, where 1 count equals 1/2400" of paper motion), which occurs at the end of time period 312.

At point 314, the leading edge of the print medium is presumed to be in contact with the feed roller pinch 114, which is stationary at this point in time, so the leading edge does not advance through the feed roller pinch 114. At point 314, the MP tray motor 140 switches to a force control mode and applies a constant force to the print medium, which is represented by curve 302B. The constant force results in a constant pushing of the print medium leading edge against the feed roller pinch 114. After a predetermined time (e.g., 50 ms) of applying the constant force with motor 140, which is represented by time period 316, the feed motor 116 is turned on at point 318, and the velocity produced by the feed motor 116 (curve 306) begins to ramp up. When the feed motor 116 is turned on at point 318, the feed roller pinch 114 begins rotating, causing the leading edge of the print medium to begin to go through the feed roller pinch 114. The print medium does not slip due to the upstream pinch forcing the print medium top edge into pinch 114. After point 318, the registration phase 303 ends and the printing phase 305 begins, and motor 140 continues to apply a constant force until the print medium has moved a predetermined amount or a predetermined number of encoder counts (e.g., 200 encoder counts), which occurs during time period 320.

At point 322, after the feed roller pinch 114 has moved the predetermined amount during time period 320, the motor 140 switches back to a position control mode, and the velocity produced by motor 140 begins to ramp up and then level off to a constant velocity, as shown by curve 302C, to drive the print medium along with motor 116 through the print zone 112 for printing. In one implementation, the velocity over time graph for duplex printing on a specialty medium is substantially the same as the graph for the MP tray 138 shown in FIG. 3.

FIG. 4 is a diagram illustrating a graph of drive velocity versus time and force versus time for driving a specialty print medium from the accessory tray 156 through the print zone 112 according to one implementation. The graph includes a load phase 401, a registration phase 403, and a print phase 405. Curves 402A and 402C represent the velocity over time produced by the MP tray motor 140, which drives the turn roller pinch 120. Curve 402B represents the force over time produced by the MP tray motor 140. Curves 402A and 402C are shown with solid lines, which represent a position control mode, and curve 402B is shown with dashed lines, which represents a push mode or a force control mode. Curves 404A and 404C represent the velocity over time produced by the accessory turn motor 148, which drives the accessory roller pinch 146. Curve 402B represents the force over time produced by the accessory turn motor 148. Curves 404A and 404C are shown with solid lines, which represent a position control mode, and curve 404B is shown with dashed lines, which represents a push mode or a force control mode. Curve 406 represents the velocity over time produced by the feed motor 116, which drives the feed roller pinch 114. Curve 406 is shown with a solid line, which represents a position control mode. Curve 408 represents the velocity over time produced by the accessory pick motor 152, which drives the accessory pick roller 150. Curve 408 is shown with a solid line, which represents a position control mode.

As shown in FIG. 4, the loading phase 401 begins with the velocities produced by the MP tray motor 140 (curve 402A), the accessory turn motor 148 (curve 404A), and the accessory pick motor 152 (curve 408) beginning to ramp up. These curves 402A, 404A, and 408 then hold steady at a constant velocity for a period of time, and then ramp back down to zero. Point 409 in the graph represents the point in time at which a pick index is triggered, and the velocity produced by the accessory pick motor 152 (curve 408) begins to ramp down to zero. Point 410 in the graph represents the point in time at which the print medium has reached the sensor 118, causing the sensor 118 to generate a signal. Point 410 also represents the point in time at which the load phase 401 ends and the registration phase 403 begins. After the signal is generated by the sensor 118, the print medium is moved a predetermined amount or a predetermined number of encoder counts (e.g., 2400 encoder counts, where 1 count equals 1/2400" of paper motion), which occurs at the end of time period 412.

At point 414, the leading edge of the print medium is in contact with the feed roller pinch 114, which is stationary at this point in time, so the leading edge does not advance through the feed roller pinch 114. At point 414, the MP tray motor 140 and the accessory turn motor 148 switch to a force control mode and apply a constant force to the print medium, which is represented by curves 402B and 404B, respectively. The constant force results in a constant pushing of the print medium against the feed roller pinch 114. After a predetermined time (e.g., 50 ms) of applying the constant force with motors 140 and 148, which is represented by time period 416, the feed motor 116 is turned on at point 418, and the velocity produced by the feed motor 116 (curve 406) begins to ramp up. When the feed motor 116 is turned on at point 418, the feed roller pinch 114 begins rotating, causing the leading edge of the print medium to begin to go through the feed roller pinch 114. The print medium does not slip due to the upstream pinch forcing the print medium top edge into pinch 114. After point 418, the registration phase 403 ends and the printing phase 405 begins, and motors 140 and 148 continue to apply a constant force until the print medium has moved a predetermined amount or a predetermined number of encoder counts (e.g., 200 encoder counts), which occurs during time period 420.

At point 422, after the feed roller pinch 114 has moved the predetermined amount during time period 420, the motors 140 and 148 switch back to a position control mode, and the velocities produced by motors 140 and 148 begin to ramp up and then level off to a constant velocity, as shown by curves 402C and 404C, respectively, to drive the print medium along with motor 116 through the print zone 112 for printing. At point 424, the velocity produced by accessory turn motor 148 ramps down as the trailing edge of the print medium leaves the rollers controlled by this motor.

Figure 5:
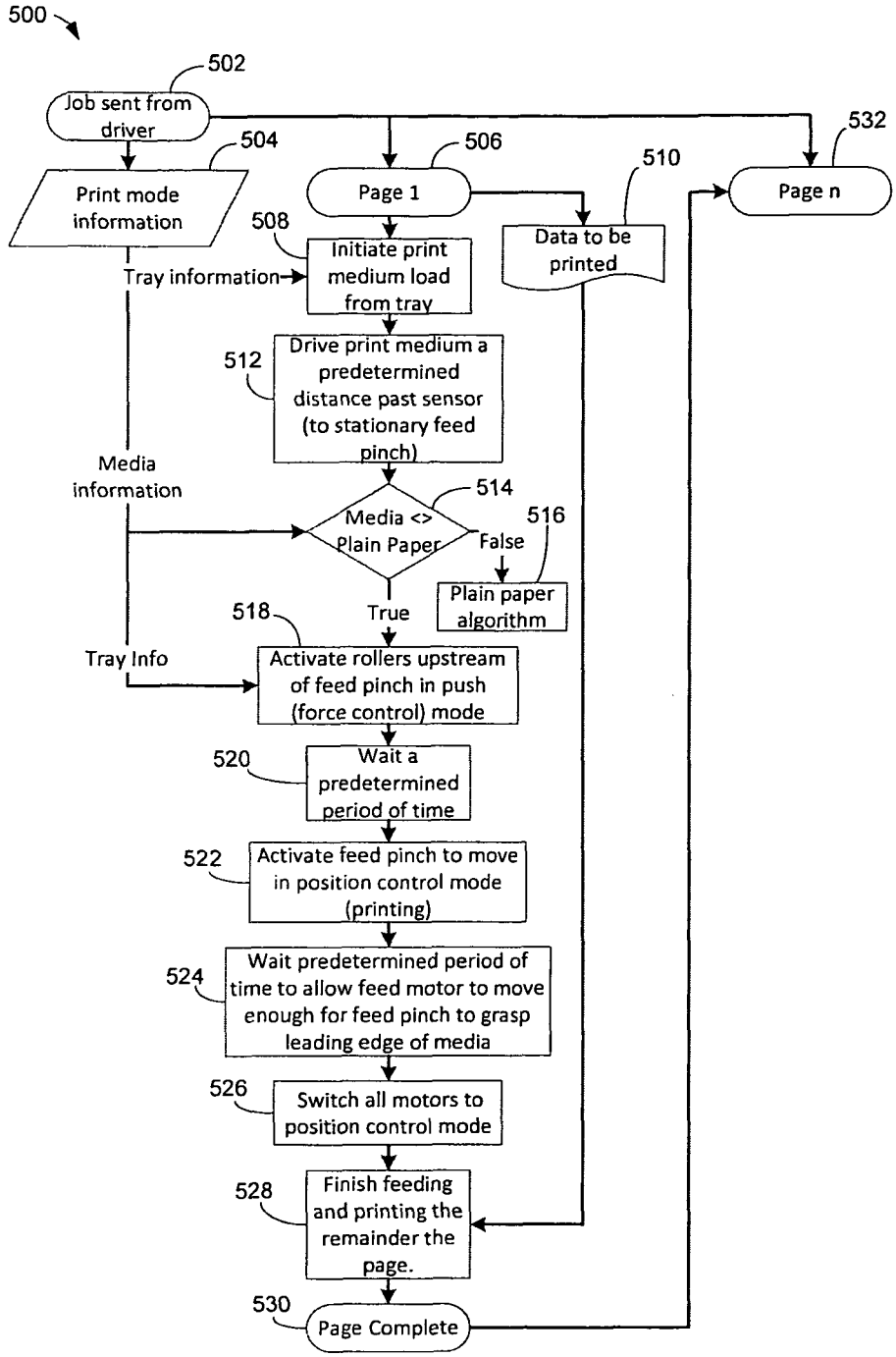
FIG. 5 is a flow diagram illustrating a method of printing on a print medium according to one implementation.

FIG. 5 is a flow diagram illustrating a method 500 of printing on a print medium according to one implementation. In one implementation, system 100 (FIG. 1) is configured to perform method 500. At 502 in method 500, a print driver sends a print job to system 100. The print job includes print mode information 504 and data to be printed 510. Beginning with the first page (page 1) 506 of the print job, the system 100, at 508, identifies a source (e.g., tray) for the print medium based on tray information in the print mode information 504, and initiates a print medium load from the identified tray. At 512, the system 100 drives the print medium a predetermined distance (e.g., 2400 encoder counts) past the sensor 118 to place the leading edge of the print medium in contact with the stationary feed roller pinch 114. At 514, based on media information in the print mode information 504, the system 100 determines whether the print medium is a specialty print medium or a plain paper print medium. If it is determined at 514 that the print medium is a plain paper print medium, the method 500 moves to 516, wherein a plain paper handling algorithm is initiated. If it is determined at 514 that the print medium is a specialty print medium, the method 500 moves to 518. Plain paper algorithm 516 could use a different type of the force control algorithm with different force settings, or it could use an algorithm without force control.

At 518 in method 500, based on the tray information in the print mode information 504, system 100 activates at least one roller upstream of the feed roller pinch 114 in a push (force control) mode to push (e.g., using a constant force) the specialty print medium against the stationary feed roller pinch 114. At 520, system 100 waits a predetermined period of time (e.g., 50 ms) while continuing to apply the constant force (step 518) to the specialty print medium. Upon completion of the predetermined period of time of waiting at 520, system 100 activates the feed roller pinch 114 to move in a position control mode at 522. At 524, system 100 waits a predetermined period of time or distance (e.g., 200 encoder counts), while continuing to apply the constant force (step 518) to the specialty print medium, to allow the feed motor 116 to move enough for the feed roller pinch 114 to grasp the leading edge of the specialty print medium. At 526, the system 100 switches all motors to position control mode to drive the specialty print medium through the print zone 112 for printing. At 528, system 100 finishes feeding and printing the remainder of the first page based on the data to be printed 510. After printing of the first page is complete at 530, the method 500 is repeated for subsequent pages 532 until the print job is finished.

Figure 6:
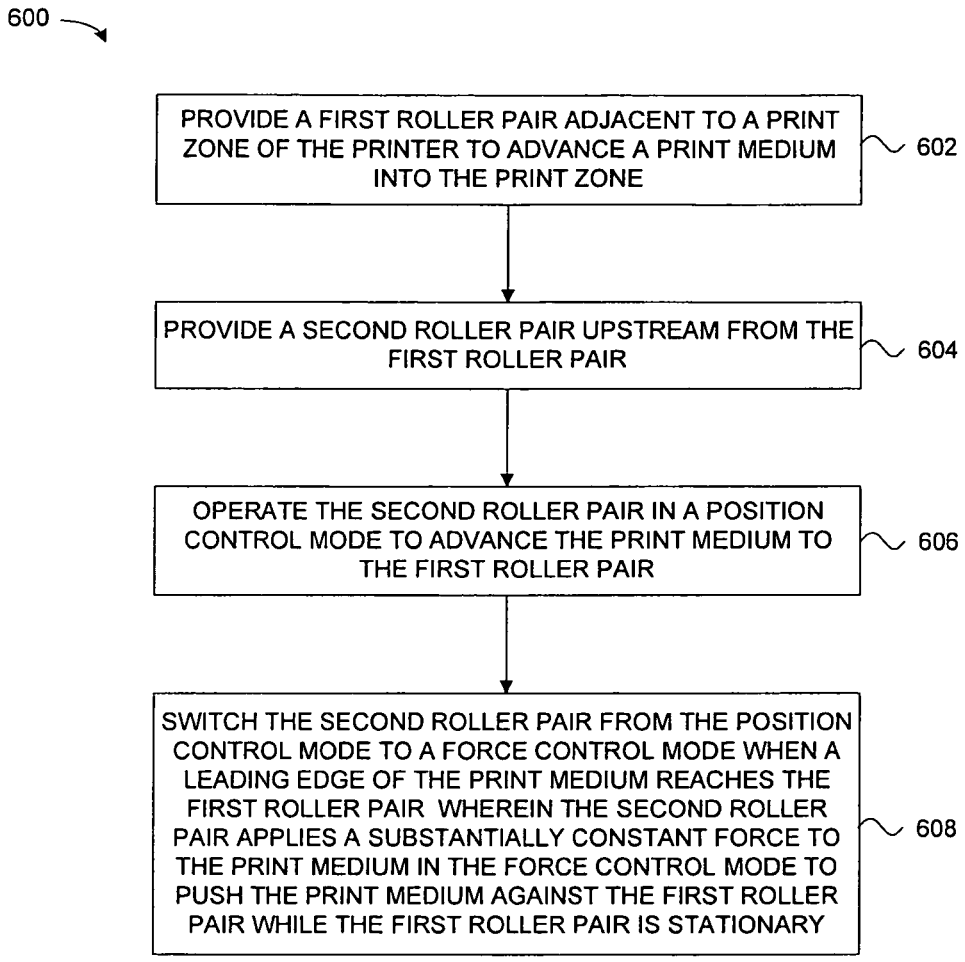
FIG. 6 is a flow diagram illustrating a method of handling a print medium in a printer according to one implementation.

FIG. 6 is a flow diagram illustrating a method 600 of handling a print medium in a printer according to one implementation. In one implementation, system 100 is configured to perform method 600. At 602 in method 600, a first roller pair is provided adjacent to a print zone of the printer to advance a print medium into the print zone. At 604, a second roller pair is provided upstream from the first roller pair. At 606, the second roller pair is operated in a position control mode to advance the print medium to the first roller pair. At 608, the second roller pair is switched from the position control mode to a force control mode when a leading edge of the print medium reaches the first roller pair, wherein the second roller pair applies a substantially constant force to the print medium in the force control mode to push the print medium against the first roller pair while the first roller pair is stationary.

In one implementation, method 600 further includes providing a media sensor positioned upstream of the first roller pair and downstream of the second roller pair; generating a signal with the media sensor when the leading edge of the print medium reaches the media sensor; and switching the second roller pair to the force control mode after the print medium has advanced a predetermined amount since generation of the signal by the media sensor.

In one implementation, method 600 further includes activating the first roller pair to begin moving a first predetermined time after the second roller pair enters the force control mode; and switching the second roller pair from the force control mode back to the position control mode after the print medium moves a predetermined amount since activation of the first roller pair, wherein the second roller pair advances the print medium toward the first roller pair when the second roller pair is switched from the force control mode to the position control mode.

Method 600 according to one implementation further includes identifying whether the print medium is a specialty print medium other than plain paper, and wherein the second roller pair is switched to the force control mode only if the print medium is identified as a specialty print medium.

One implementation is directed to a printing system, which includes a printhead to eject ink onto a print medium in a print zone. A first roller pair is adjacent to the print zone to advance a print medium into the print zone. A second roller pair upstream from the first roller pair, and driven by an independent motor, advances the print medium to the first roller pair in a position control mode. A controller causes the second roller pair to switch from the position control mode to a force control mode when a leading edge of the print medium reaches the first roller pair. The second roller pair applies a substantially constant force to the print medium in the force control mode to push the leading edge of the print medium against the first roller pair while the first roller pair is stationary. The leading edge of the print medium is thus well registered with the pinch of the first roller pair, and reliably enters the pinch when the first roller pair begins to rotate. The constant force of the leading edge against the first roller pair helps ensure that the leading edge enters the first roller pinch immediately as the roller begins to move, thus helping to ensure consistent edge registration. This registration allows the print system to maintain a uniform white space across many printed pages, leading to improved customer satisfaction.

The printing system according to one implementation includes a media sensor positioned upstream of the first roller pair and downstream of the second roller pair, wherein the media sensor generates a signal when the leading edge of the print medium reaches the media sensor. In one form of this implementation, the controller causes the second roller pair to switch to the force control mode after the print medium has advanced a predetermined amount since generation of the signal by the media sensor. The controller activates the first roller pair to begin moving a first predetermined time after the second roller pair enters the force control mode. The controller causes the second roller pair to switch from the force control mode back to the position control mode after the print medium moves a predetermined amount of distance or time since activation of the first roller pair. The second roller pair advances the print medium toward the first roller pair when the second roller pair is switched from the force control mode to the position control mode.

In one implementation of the printing system, the controller determines whether the print medium is a specialty print medium other than plain paper, and causes the second roller pair to switch to the force control mode only if the print medium is a specialty print medium. The controller determines whether the print medium is a specialty print medium based on information provided by a print driver for a print job.

The printing system according to one implementation further includes a third roller pair upstream from the second roller pair to advance the print medium to the second roller pair in a position control mode. The controller causes the third roller pair to switch from the position control mode to the force control mode when the leading edge of the print medium reaches the first roller pair, wherein the third roller pair applies a substantially constant force to the print medium in the force control mode to push the print medium against the first roller pair while the first roller pair is stationary. In one implementation, the printing system comprises a page wide array (PWA) inkjet printing system.

Another implementation is directed to a system for advancing a specialty print medium through a printer. The system includes a first roller pinch adjacent to a print zone of the printer to advance a specialty print medium into the print zone. A second roller pinch upstream from the first roller pinch advances the specialty print medium to the first roller pinch in a position control mode. A controller causes the second roller pinch to switch from the position control mode to a force control mode when a leading edge of the specialty print medium reaches the first roller pinch, wherein the force control mode causes the second roller pinch to push the print medium against the first roller pinch while the first roller pinch is stationary.

Specific implementations disclosed herein provide improved top of form registration on specialty media. Implementations eliminate severe top margin variation problems, and failure rates have reduced from as high as 100% down to 0%. Specific implementations use existing hardware to provide a low cost alternative to using extra sensors. Since an additional contamination-prone optical or mechanical sensor is eliminated, this method improves overall system robustness. By not adding a sensor into the paper path, the paper path can be made smaller. The force control mode used by specific implementations also helps ensure that the top edge of the media is optimally aligned with the feed roller, which provides improved deskew performance.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A printing system, comprising:

a printhead to eject ink onto a print medium in a print zone;

a first roller pair adjacent to the print zone to advance a print medium into the print zone;

a second roller pair upstream from the first roller pair, and driven by an independent motor, to advance the print medium to the first roller pair in a position control mode;

a controller to cause the second roller pair to switch from the position control mode to a force control mode when a leading edge of the print medium reaches the first roller pair, wherein the second roller pair applies a substantially constant force to the print medium in the force control mode to push the leading edge of the print medium against the first roller pair with the substantially constant force while the first roller pair is stationary; and wherein the controller determines whether the print medium is a specialty print medium other than plain paper, and causes the second roller pair to switch to the force control mode only if the print medium is a specialty print medium.

2. The printing system of claim 1, and further comprising:

a media sensor positioned upstream of the first roller pair and downstream of the second roller pair, the media sensor generating a signal when the leading edge of the print medium reaches the media sensor.

3. The printing system of claim 2, wherein the controller causes the second roller pair to switch to the force control mode after the print medium has advanced a predetermined amount since generation of the signal by the media sensor.

4. The printing system of claim 3, wherein the controller activates the first roller pair to begin moving a first predetermined time after the second roller pair enters the force control mode.

5. The printing system of claim 4, wherein the controller causes the second roller pair to switch from the force control mode back to the position control mode after the print medium moves a predetermined amount of distance or time since activation of the first roller pair.

6. The printing system of claim 5, wherein the second roller pair advances the print medium toward the first roller pair when the second roller pair is switched from the force control mode to the position control mode.

7. The printing system of claim 1, wherein the controller determines whether the print medium is a specialty print medium based on information provided by a print driver for a print job.

8. The printing system of claim 1, and further comprising:

a third roller pair upstream from the second roller pair to advance the print medium to the second roller pair in a position control mode; and wherein the controller causes the third roller pair to switch from the position control mode to the force control mode when the leading edge of the print medium reaches the first roller pair, wherein the third roller pair applies a substantially constant force to the print medium in the force control mode to push the print medium against the first roller pair while the first roller pair is stationary.

9. The printing system of claim 1, wherein the printing system comprises a page wide array (PWA) inkjet printing system.

10. A method of handling a print medium in a printer, the method comprising:

providing a first roller pair adjacent to a print zone of the printer to advance a print medium into the print zone;

providing a second roller pair upstream from the first roller pair;

operating the second roller pair in a position control mode to advance the print medium to the first roller pair;

switching the second roller pair from the position control mode to a force control mode when a leading edge of the print medium reaches the first roller pair, wherein the second roller pair applies a substantially constant force to the print medium in the force control mode to push the print medium against the first roller pair with the substantially constant force while the first roller pair is stationary; and identifying whether the print medium is a specialty print medium other than plain paper, and wherein the second roller pair is switched to the force control mode only if the print medium is identified as a specialty print medium.

11. The method of claim 10, and further comprising:

providing a media sensor positioned upstream of the first roller pair and downstream of the second roller pair;

generating a signal with the media sensor when the leading edge of the print medium reaches the media sensor; and switching the second roller pair to the force control mode after the print medium has advanced a predetermined amount since generation of the signal by the media sensor.

12. The method of claim 11, and further comprising:

activating the first roller pair to begin moving a first predetermined time after the second roller pair enters the force control mode; and switching the second roller pair from the force control mode back to the position control mode after the print medium moves a predetermined amount since activation of the first roller pair, wherein the second roller pair advances the print medium toward the first roller pair when the second roller pair is switched from the force control mode to the position control mode.

13. A system for advancing a specialty print medium through a printer, the system comprising:

a first roller pinch adjacent to a print zone of the printer to advance a print medium into the print zone;

a second roller pinch upstream from the first roller pinch to advance the print medium to the first roller pinch in a position control mode;

a controller that causes the second roller pinch to switch from the position control mode to a force control mode when a leading edge of the print medium reaches the first roller pinch, wherein the force control mode causes the second roller pinch to push the print medium against the first roller pinch with a substantially constant force while the first roller pinch is stationary; and wherein the controller determines whether the print medium is a specialty print medium other than plain paper, and causes the second roller pinch to switch to the force control mode only if the print medium is a specialty print medium.

* * * * *